US009555336B2

(12) United States Patent
Walz et al.

(10) Patent No.: US 9,555,336 B2
(45) Date of Patent: Jan. 31, 2017

(54) METHOD AND APPARATUS FOR INFLATING A BALLOON

(71) Applicant: Kintech, Inc., Warren, MI (US)

(72) Inventors: Robert Walz, Shelby Township, MI (US); Michael Kinzel, Milford, MI (US); Daniel O'Leary, Washington, MI (US)

(73) Assignee: KINTECH, INC., Warren, MI (US)

( * ) Notice: Subject to any disclaimer, the term of this patent is extended or adjusted under 35 U.S.C. 154(b) by 202 days.

(21) Appl. No.: 14/509,703

(22) Filed: Oct. 8, 2014

(65) Prior Publication Data

US 2016/0101367 A1 Apr. 14, 2016

(51) Int. Cl.
*A63H 27/10* (2006.01)

(52) U.S. Cl.
CPC ..... *A63H 27/10* (2013.01); *A63H 2027/1033* (2013.01)

(58) Field of Classification Search
CPC ..... A63H 2027/1033
USPC ..... 141/9–10, 100, 114, 313–317, 391
See application file for complete search history.

(56) References Cited

U.S. PATENT DOCUMENTS 1,411,062 A 3/1922 Needham
3,161,998 A * 12/1964 Lennox ..... A63H 27/10 141/313
3,191,801 A * 6/1965 Standish ..... G07F 11/00 141/317
3,380,490 A * 4/1968 Ellenberg ..... G07F 11/00 141/167
3,536,110 A * 10/1970 West ..... G07F 13/02 141/137
3,692,071 A * 9/1972 Begleiter ..... F16K 15/202 137/512.3
3,762,439 A * 10/1973 Heath ..... A61M 16/12 137/549
4,156,591 A 5/1979 Anderson
4,412,568 A * 11/1983 Hughes ..... F04F 5/463 137/114
5,016,428 A * 5/1991 Helling ..... A63H 27/10 141/173
5,067,301 A * 11/1991 Shore ..... A63H 27/10 53/138.8
5,121,595 A * 6/1992 Shore ..... A63H 27/10 141/173
5,651,402 A * 7/1997 McCaul ..... A63H 27/10 141/114

(Continued)

*Primary Examiner* — Nicolas A Arnett
(74) *Attorney, Agent, or Firm* — Quinn Law Group, PLLC

(57) ABSTRACT

A balloon inflating device includes a gas mixing device fluidly connecting a supply of pressurized lighter-than-air (LTA) gas and a supply of a second gas to a balloon interface nozzle via a gas shut-off valve. The gas mixing device includes an outer pipe including a closed first end, an inner chamber, an inner pipe that projects through the closed first end of the outer pipe into the inner chamber, a first fluidic inlet and an outlet port. The inner pipe includes a second fluidic inlet into the inner chamber. The second fluidic inlet fluidly connects to the supply of LTA gas. The first fluidic inlet is proximal to the closed first end and fluidly connects to the supply of the second gas. A second end of the outer pipe fluidly connects to the outlet port. The outlet port fluidly connects via the gas shut-off valve to the balloon interface nozzle.

20 Claims, 3 Drawing Sheets

(56) References Cited

U.S. PATENT DOCUMENTS

| | | | | |
|---|---|---|---|---|
| 5,653,272 | A * | 8/1997 | McCaul | A63H 27/10 141/1 |
| 6,408,902 | B1 * | 6/2002 | Liau | A63H 27/10 141/105 |
| 6,478,057 | B1 | 11/2002 | Bearss et al. | |
| 6,719,020 | B1 * | 4/2004 | Bisotto | A63H 27/10 141/100 |
| 6,892,770 | B2 * | 5/2005 | Ratermann | A63H 27/10 141/114 |
| 7,993,130 | B2 | 8/2011 | Lewin et al. | |
| 8,132,599 | B2 * | 3/2012 | Crandell | A63H 27/10 141/114 |
| 2005/0076968 | A1 * | 4/2005 | Ratermann | A63H 27/10 141/114 |

* cited by examiner

METHOD AND APPARATUS FOR INFLATING A BALLOON

TECHNICAL FIELD

This disclosure relates generally to devices and methods for inflating balloons.

BACKGROUND

Vendors of inflated ornamental balloons expend labor and incur material costs in the form of the balloons, strings and helium. Product consistency is important in satisfying customers while managing costs.

SUMMARY

A balloon inflating device is described and includes a gas mixing device fluidly connecting a supply of pressurized lighter-than-air (LTA) gas and a supply of a second gas to a balloon interface nozzle via a gas shut-off valve. The gas mixing device includes an outer pipe including a closed first end, an inner chamber, an inner pipe that projects through the closed first end of the outer pipe into the inner chamber, a first fluidic inlet and an outlet port. The inner pipe includes a second fluidic inlet into the inner chamber. The second fluidic inlet fluidly connects to the supply of LTA gas. The first fluidic inlet is proximal to the closed first end and fluidly connects to the supply of the second gas. A second end of the outer pipe fluidly connects to the outlet port. The outlet port fluidly connects via the gas shut-off valve to the balloon interface nozzle.

The above features and advantages, and other features and advantages, of the present teachings are readily apparent from the following detailed description of some of the best modes and other embodiments for carrying out the present teachings, as defined in the appended claims, when taken in connection with the accompanying drawings.

BRIEF DESCRIPTION OF THE DRAWINGS

One or more embodiments will now be described, by way of example, with reference to the accompanying drawings, in which.

DETAILED DESCRIPTION

Figure 1:
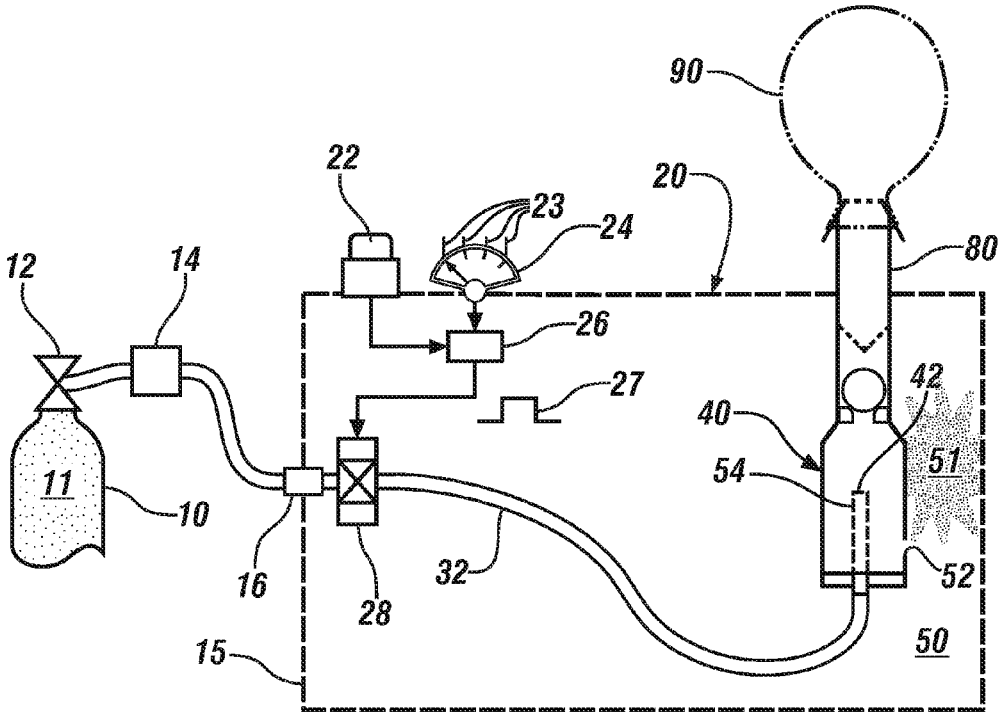
FIG. 1 schematically illustrates a balloon inflating device for inflating an ornamental balloon with a mixture of lighter-than-air (LTA) gas and a second gas, in accordance with the disclosure.

Referring now to the drawings, wherein the depictions are for the purpose of illustrating certain exemplary embodiments only and not for the purpose of limiting the same, FIG. 1 schematically illustrates a balloon inflating device 20 for advantageously inflating an ornamental balloon 90 with a mixture of lighter-than-air (LTA) gas 11 and a second gas 51. Like numerals refer to like elements throughout the embodiments and figures.

A pressurized LTA gas source 10 that preferably includes a pressurized tank containing LTA gas 11 includes a manually controlled shutoff valve 12 and pressure regulator 14, and fluidly connects to the balloon inflating device 20 via a fluidic connector 16 that is attached to a box 15 containing the balloon inflating device 20. The connector 16 is a quick-connect device in one embodiment. The connector 16 fluidly connects to a controllable flow control valve 28 which is a solenoid-controlled gas shut-off valve 28 in one embodiment. The solenoid-controlled gas shut-off valve 28 fluidly connects via suitable impermeable tubing 32 to an inner pipe 54 of a gas mixing device 40. The solenoid-controlled gas shut-off valve 28 signally connects to a controller 26 that connects to an operator-controllable actuator 22, e.g., a button or switch, and an operator-controllable selector 24. The operator-controllable selector 24 includes a plurality of selectable values 23 for a balloon parameter of interest. The balloon parameter of interest can be any suitable parameter, and is an inflated balloon diameter in one embodiment. The gas mixing device 40 includes the inner pipe 54 including a second fluidic inlet 42 that fluidly connects to the pressurized LTA gas source 10 supplying the LTA gas 11 and a first fluidic inlet 52 that fluidly connects to a second gas source 50 supplying the second gas 51. The gas mixing device 40 fluidly connects to a balloon inflation nozzle 80, on which an inlet tube of the balloon 90 is placed in an uninflated state. In one embodiment, the LTA gas 11 is helium, but the disclosure is not so limited. The LTA gas 11 can be any suitable LTA gas, such as methane, hydrogen, or another gas. In one embodiment the second gas source 50 is the atmosphere and the second gas 51 is ambient air at atmospheric pressure, but the disclosure is not so limited. The second gas 51 can be any suitable gas, such as nitrogen provided at a pressure that is preferably at or near atmospheric pressure proximal to the first fluidic inlet 52.

In operation, an operator selects one of the operator-selectable values 23 for the balloon parameter and initiates filling the balloon 90 by actuating the actuator 22, which can include pushing a button or toggling a switch. The controller 26 sends an activation signal 27 associated with a predetermined parameter to activate the solenoid-controlled gas shut-off valve 28 to permit flow of the pressurized LTA gas 11 through the gas mixing device 40 that mixes with the second gas 51 to fill and thus inflate the balloon 90. In one embodiment, the predetermined parameter that commands the activation signal 27 is an elapsed activation time associated with the selected value for the balloon parameter as determined through the operator-controllable selector 24. Thus, in one embodiment a process for filling and inflating the balloon 90 includes activating the solenoid-controlled gas shut-off valve 28 for a selected period of time to effect flow of the pressurized LTA gas 11 to mix with the second gas 51, with the resulting mixture flowing into the balloon 90 mounted on the nozzle 80. When the activation signal 27 ends, the solenoid-controlled gas shut-off valve 28 deactivates and shuts off flow of the pressurized LTA gas 11, and inflation of the balloon 90 ends. When flow of the pressurized LTA gas 11 is shut off, a shut-off valve 70 (shown with reference to FIG. 2) interrupts outflow of the mixture of the LTA gas 11 and the second gas 51 contained in the balloon 90 mounted on the nozzle 80, thus preventing deflation of the inflated balloon 90. The operator can then tie off the end of the balloon 90 and remove it from the nozzle 80.

Figure 2:
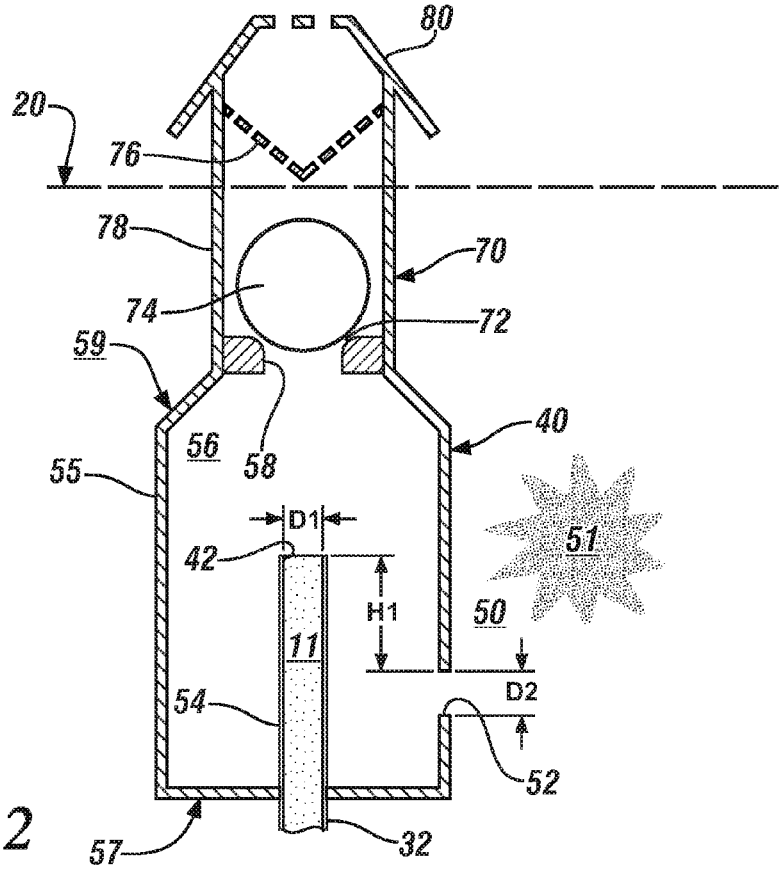
FIG. 2 schematically shows a two-dimensional cross-sectional cut-away view of an embodiment of a gas mixing device fluidly connected to a nozzle via a shut-off valve, in accordance with the disclosure.

FIG. 2 schematically shows a two-dimensional cross-sectional cut-away view of an embodiment of the gas mixing device 40 fluidly connected to the nozzle 80 via a shut-off valve 70. The gas mixing device 40 includes an outer hollow cylindrical pipe 55 defining a mixing chamber 56. The outer pipe 55 has a closed first end 57 except at an opening through which the inner pipe 54 passes. Thus, the closed first end 57 of the outer pipe 55 is impermeable to flow of gas except through the inner pipe 54. The outer pipe 55 has an opened circular-shaped second end 59 that is preferably reduced in diameter and forms an annular outlet port 58 that serves as a seat 72 for the shut-off valve 70. An inner pipe 54 is inserted into the outer pipe 55, preferably concentric thereto, and fluidly connects via the tubing 32 to the pressurized LTA gas source 10 shown with reference to FIG. 1. The inner pipe 54 terminates at an aperture at the second fluidic inlet 42, thus permitting LTA gas 11 to flow into the mixing chamber 56. The second fluidic inlet 42 has a first inside diameter D1, and the first inside diameter D1 may be the same as an inside diameter of the inner pipe 54, or less than the inside diameter of the inner pipe 54. Furthermore, the second fluidic inlet 42 having the first inside diameter D1 is shown as a single aperture on an end of the inner pipe 54, but may instead be implemented as a plurality of apertures placed near the distal end of the inner pipe 54, with the distal end fluidly closed. Thus gases only enter into the mixing chamber 56 through the second fluidic inlet 42 and the first fluidic inlet 52.

The outer pipe 55 includes the first fluidic inlet 52 that fluidly connects the mixing chamber 56 and the second gas source 50. The first fluidic inlet 52 is shown as a single circular aperture having a second diameter D2. Alternatively, the first fluidic inlet 52 can be two or more circular apertures or aperture(s) having any suitable cross-sectional shape.

The inner pipe 54 is arranged and oriented in the inner chamber 56 with the aperture of the second fluidic inlet 42 located proximal to the second end 59 of the outer pipe 55 and downstream of the first fluidic inlet 52, with the term 'downstream' defined in relation to fluidic flow towards the second end 59 of the outer pipe 55.

In operation, the pressurized LTA gas 11 flows through the second fluidic inlet 42 into the mixing chamber 56 and is exposed to atmospheric pressure flowing through the first fluidic inlet 52. The change in velocity and pressure of the pressurized LTA gas 11 flowing from the tubing 32 through the aperture of the second fluidic inlet 42 acts as a venturi with an associated change in speed and pressure of the LTA gas 11 as it flows into the mixing chamber 56. The venturi effect of the LTA gas 11 flowing from the inner pipe 54 at smaller diameter and higher pressure into the mixing chamber 56 having a larger diameter and a lower pressure generates a pressure differential between the mixing chamber 56 and the second gas source 50. The pressure differential siphons the second gas 51 through the first fluidic inlet 52 into the mixing chamber 56. The second gas 51 mixes with the pressurized LTA gas 11 in the mixing chamber 56 and the resulting mixture flows through the aperture formed in the annular outlet port 58 of the second end 59 of the outer pipe 55 through the shut-off valve 70 and the nozzle 80 into the balloon 90.

The design parameters of the gas mixing device 40 can be selected to achieve a preferred ratio of the pressurized LTA gas 11 and the second gas 51. Design parameters of interest include the pressure of the LTA gas 11, the first inside diameter D1 of the second fluidic inlet 42 or a functionally equivalent cross-sectional area, the second diameter D2 of the first fluidic inlet 52 or a functionally equivalent cross-sectional area when multiple first fluidic inlets 52 are employed, and the pressure of the second gas source 50. The first equivalent cross-sectional area of the second fluidic inlet 42 and the second equivalent cross-sectional area of the first fluidic inlet(s) 52 are selected to achieve a preferred volumetric ratio of LTA gas/second gas when the LTA gas 11 is pressurized at a selected regulated pressure and the second gas 51 is at a second pressure, e.g., atmospheric pressure at or near sea level. Thus, in one embodiment, to achieve a volumetric ratio of 60% LTA gas/40% second gas flowing into the balloon 90 when the LTA gas 11 is helium from a pressurized tank at a regulated pressure of 50 psig and the second gas 51 is ambient air at atmospheric pressure near sea level, the first inside diameter D1 of the inner pipe 54 defining the second fluidic inlet 42 is 0.050 inches, an inside diameter of the outer pipe 55 is 0.375 inches and the second diameter D2 of the first fluidic inlet 52 is 0.175 inches. Height H1 may be selected to effect mixing of the LTA gas 11 and the second gas 51.

The shut-off valve 70 is a pressure-controlled ball valve device that fluidly connects to the balloon interface nozzle 80 and includes an outer pipe 78, seat 72, ball valve 74, and shutoff guard 76. The outer pipe 78 fluidly connects between the mixing chamber 56 and the nozzle 80, and contains the ball valve 74. The ball valve 74 has an outside diameter that is less than an inside diameter of the outer pipe 78. Under static conditions, the ball valve 74 is in a closed state due to effect of gravity thereon, resting on the seat 72 and completely interrupting flow through the annular outlet port 58 of the inner chamber 56 and the nozzle 80. During balloon inflation when pressurized LTA gas 11 is flowing into the gas mixing device 40, the pressure urges the ball valve 74 away from the seat 72 and permits flow around the ball valve 74 to the nozzle 80. The shutoff guard 76 is an air-permeable device that prevents the ball valve 74 from closing flow to the nozzle 80 when the pressurized LTA gas 11 is flowing and mixing with the second gas 51. When the flow of the pressurized LTA gas 11 is discontinued, e.g., by deactivation of the solenoid-controlled gas shut-off valve 28, the pressure within the balloon 90 urges the ball valve 74 towards the seat 72, which seals and cuts off flow and prevents deflation of the inflated balloon 90.

Figure 3:
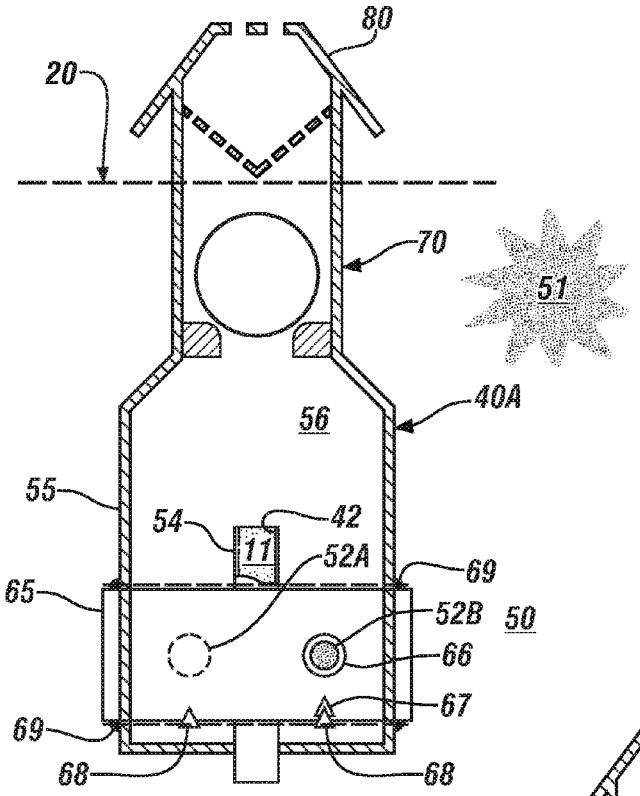
FIG. 3 schematically shows a two-dimensional cross-sectional cut-away view of another embodiment of the gas mixing device fluidly connected to a nozzle via a shut-off valve and incorporating multiple first fluidic inlets of different aperture sizes, in accordance with the disclosure.

FIG. 3 schematically shows a two-dimensional cross-sectional cut-away view of another embodiment of the gas mixing device 40A fluidly connected to the nozzle 80 via the shut-off valve 70. This embodiment of the gas mixing device 40A incorporates multiple first fluidic inlets 52A and 52B through which the second gas 51 flows. The first fluidic inlets 52A and 52B have different-sized apertures that are selectable. As shown, there are two first fluidic inlets 52A and 52B having different-sized apertures. Alternatively, there can be any quantity 'n' of first fluidic inlets 52*n* (not shown). Thus, the description of multiple first fluidic inlets 52A and 52B having different-sized apertures is non-limiting, and other configurations of the second fluidic inlet 42 and the first fluidic inlet 52 achieving differing cross-sectional areas and differing flowrates of the LTA gas 11 and the second gas 51 fall within the scope of this disclosure.

The gas mixing device 40A includes the outer hollow cylindrical pipe 55, the mixing chamber 56 and the inner pipe 54. The inner pipe 54 has a second fluidic inlet 42 at its distal end through which the LTA gas 11 flows into the mixing chamber 56 and a first inside diameter D1. The outer pipe 55 includes multiple first fluidic inlets 52A and 52B that fluidly connect the mixing chamber 56 and the second gas source 50. The first fluidic inlets 52A and 52B are each shown as single circular apertures having second diameters D2-A and D2-B, respectively wherein the second diameter D2-A differs from the second diameter D2-B. The gas mixing device 40A is designed to achieve a volumetric ratio of 60% LTA gas/40% second gas flowing into the balloon 90 with the first fluidic inlet 52A having one circular aperture having second diameter D2-A under nominal operating conditions. The gas mixing device 40A is designed to achieve a volumetric ratio of 90% LTA gas/10% second gas flowing into the balloon 90 with the first fluidic inlet 52B having one circular aperture having second diameter D2-B or another suitable ratio under nominal operating conditions. The nominal operating conditions may include, by way of a non-limiting example, the LTA gas 11 originating from a pressurized tank at a regulated pressure of 50 psig and the second gas 51 originating from ambient air at atmospheric pressure near sea level. A concentric outer sleeve 65 fits around the outer portion of the outer pipe 55 and slidably rotates around a longitudinal axis of the outer pipe 55 to sealingly fit overtop either one or both the first fluidic inlets 52A and 52B. The outer pipe 55 preferably has a detent 69 into which the sleeve 65 fits and also preferably has a plurality of index points 68 arranged contiguous to the first fluidic inlets 52A and 52B. The concentric outer sleeve 65 as shown includes a single aperture 66 and an index cutout 67 arranged contiguous to the single aperture 66. When the outer sleeve 65 is rotated to a first position (as shown), the first fluidic inlet 52B is opened and the first fluidic inlet 52A is closed, thus permitting flow of the second gas 51 only through the first fluidic inlet 52B during balloon inflation. This preferably achieves a first volumetric ratio of the LTA gas 11 and the second gas 51. When the outer sleeve 65 is rotated to a second position, the first fluidic inlet 52B is closed and the first fluidic inlet 52A is opened, thus permitting flow of the second gas 51 only through the first fluidic inlet 52A during balloon inflation. This preferably achieves a second volumetric ratio of the LTA gas 11 and the second gas 51. When the outer sleeve 65 is rotated to a third position, the first fluidic inlet 52B and the first fluidic inlet 52A are both closed, thus prohibiting flow of the second gas 51 during balloon inflation. This preferably achieves a flow of 100% LTA gas into the balloon 90. The different volumetric ratios accommodate balloons fabricated from different materials such as latex, foil and others. The use of different fill times or another control parameter facilitates reliable, consistent inflation of balloon of different sizes and volumes.

Figure 4:
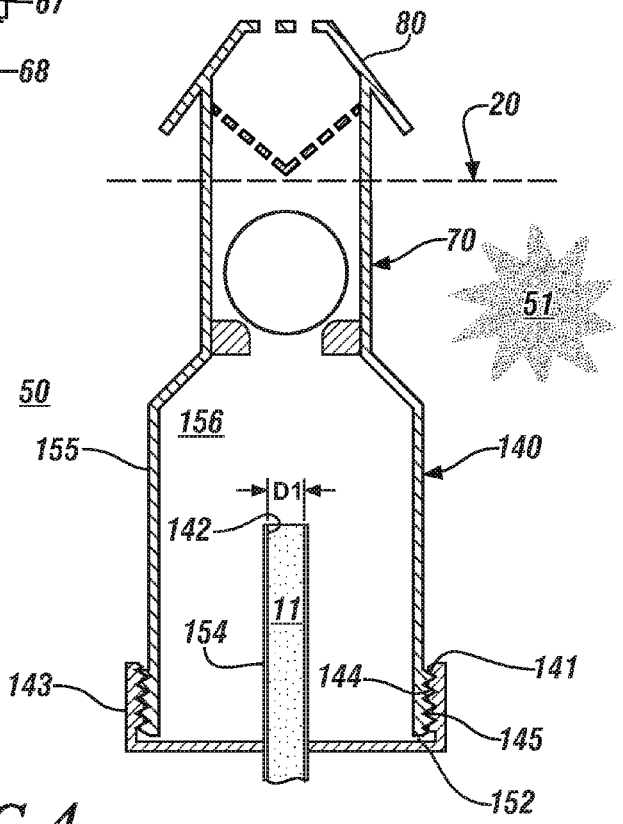
FIG. 4 schematically shows a two-dimensional cross-sectional cut-away view of another embodiment of the gas mixing device fluidly connected to a nozzle via shut-off valve and incorporating a first fluidic inlet through a threaded coupling between a cap and an outer pipe, in accordance with the disclosure.

FIG. 4 schematically shows a two-dimensional cross-sectional cut-away view of another embodiment of the gas mixing device 140 fluidly connected to the nozzle 80 via shut-off valve 70. In this embodiment, a first fluidic inlet including a flowpath 145 and gap 152 is fabricated through a threaded coupling between a cap 143 and outer pipe 155 in a manner that achieves fluidic flow of the second gas 51 through the gap 152 and flowpath 145 between threads 141 and mating threads 144 of the threaded coupling when there is a pressure differential between the mixing chamber 156 and the second gas source 50. This embodiment of the gas mixing device 140 includes an outer hollow cylindrical pipe 155 having an external helical male threaded section 141 that threadably couples to mating helical threads 144 of the threaded cap 143 and forms the mixing chamber 156 therein. Inner pipe 154 projects through an aperture in an end of the threaded cap 143. The inner pipe 154 has a second fluidic inlet 142 having a first inside diameter D1 at its distal end through which the LTA gas 11 flows into the mixing chamber 156. The outer pipe 155 includes male threaded section 141 that helically winds around an outer periphery of the pipe 155 at its bottom. The threaded cap 143 includes female threads 144 that helically wind around an inner periphery thereof and mate with the male threaded section 141 of the outer pipe 155. In one embodiment, the female threads 144 are truncated. When the threaded cap 143 is assembled onto the outer pipe 155, the gap 152 is formed between the threaded cap 143 and the outer pipe 155. The fluidic flow path 145 from second gas source 50 through the gap 152 to the mixing chamber 156 is formed between the truncated female threads 144 and the male threaded section 141 when the threaded cap 143 is assembled onto the outer pipe 155. Rotation of the threaded cap 143 relative to the outer pipe 155 adjusts the size of the gap 152, with a corresponding adjustment in the mixture of the LTA gas 11 and the second gas 51. This provides an infinitely variable adjustment to the size in the gap 152, with a correspondingly infinitely variable mixture of the LTA gas 11 and the second gas 51. Such adjustability may be advantageously applied to adjust and control volumetric ratios of the LTA gas 11 and the second gas 51 of the when the device is employed in areas of low ambient pressure, such as at locations that are significantly above sea level. One skilled in the art is able to develop a suitable calibration mechanism to adjust and control volumetric ratios of the LTA gas 11 and the second gas 51. The different volumetric ratios accommodate balloons fabricated from different materials such as latex, foil and others. The use of different fill times or another control parameter facilitates reliable, consistent inflation of balloon of different sizes and volumes.

Figure 5:
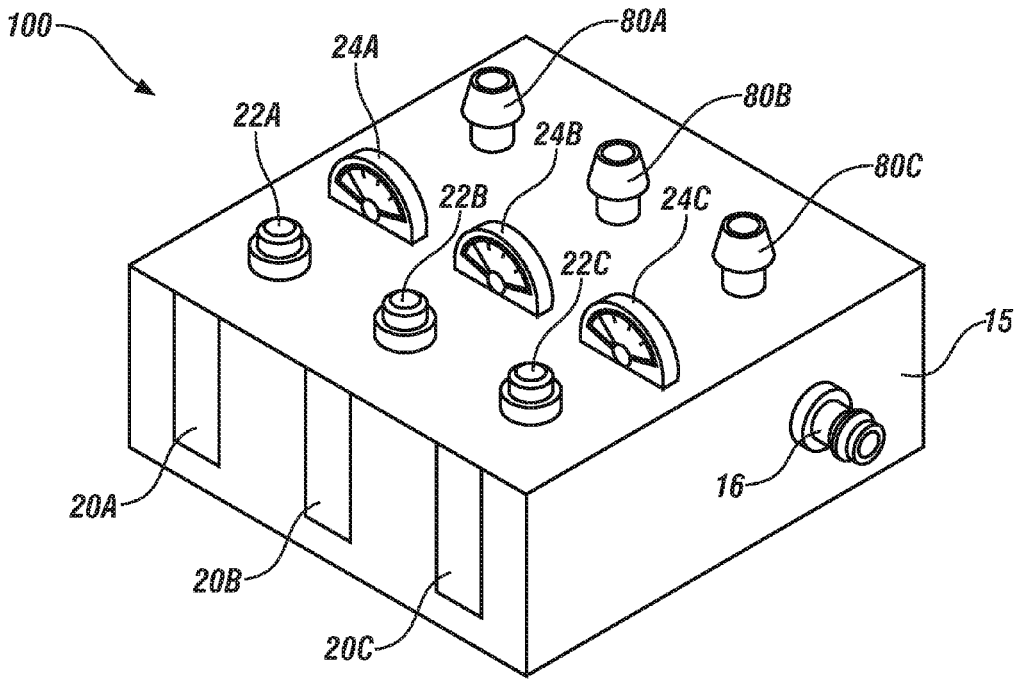
FIG. 5 schematically shows an isometric view of an operator control panel that includes multiple balloon inflating devices for inflating balloons with different mixtures of lighter-than-air (LTA) gas and a second gas, in accordance with the disclosure.

FIG. 5 schematically shows an isometric view of an operator control panel 100 that includes multiple balloon inflating devices 20A, 20B and 20C for inflating balloons with different mixtures of lighter-than-air (LTA) gas 11 and a second gas 51. Illustrated portions of the balloon inflating devices 20A, 20B and 20C include corresponding operator-controllable actuators 22A, 22B and 22C, respectively, corresponding operator-controllable selectors 24A, 24B and 24C, respectively and nozzles 80A, 80B and 80C.

Other depicted elements include a single fluidic connector 16 that supplies the LTA gas 11 to all of the multiple balloon inflating devices 20A, 20B and 20C through a manifold or other suitable device, and box 15. The different balloon inflating devices 20A, 20B and 20C are configured to provide consistent, repeatable and reliable inflation of balloons at different volumetric ratios of the LTA gas 11 and the second gas 51 to simultaneously accommodate balloons fabricated from different materials such as latex, foil and other materials over a variety of sizes with known volumes. This permits a single device to be employed to inflate different balloons at different volumetric ratios of the LTA gas 11 and the second gas 51 without operator adjustment.

The term controller, control module, module, control, control unit, processor and similar terms refer to any one or various combinations of Application Specific Integrated Circuit(s) (ASIC), electronic circuit(s), timers, central processing unit(s), e.g., microprocessor(s) and associated memory and storage devices (read only, programmable read only, random access, hard drive, etc.) executing one or more software or firmware programs or routines, combinational logic circuit(s), input/output circuit(s) and devices, signal conditioning and buffer circuitry and other components to provide a described functionality. Software, firmware, programs, instructions, control routines, code, algorithms and similar terms mean any controller-executable instruction sets including calibrations and look-up tables. A controller executes control routine(s) to provide desired functions, including monitoring inputs from sensing devices and executing control routines to control operation of actuators. Communications between controllers, actuators and/or sensors may be accomplished using a direct wired link, a networked communications bus link, a wireless link or any another suitable communications link.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

The invention claimed is:

1. A balloon inflating device, comprising:

a gas mixing device fluidly connecting a supply of pressurized lighter-than-air (LTA) gas and a supply of a second gas to a balloon interface nozzle via a gas shut-off valve;

the gas mixing device including an outer pipe including a closed first end, an inner chamber, an inner pipe projecting through the closed first end of the outer pipe into the inner chamber, a first fluidic inlet and an outlet port, wherein the inner pipe includes a second fluidic inlet into the inner chamber;

the second fluidic inlet fluidly connecting to the supply of LTA gas;

the first fluidic inlet proximal to the closed first end and fluidly connecting to the supply of the second gas;

a second end of the outer pipe fluidly connecting to the outlet port; and the outlet port fluidly connecting to the balloon interface nozzle via the gas shut-off valve;

wherein the gas shut-off valve includes an outer pipe, a seat, a ball valve and a shutoff guard, wherein the seat is formed on an annular outlet of the outlet port of the gas mixing device, the outer pipe houses the ball valve, and the shutoff guard is located between the ball valve and the balloon interface nozzle.

2. The balloon inflating device of claim 1, further comprising the second fluidic inlet fluidly connecting to the supply of pressurized LTA gas via a controllable shut-off valve.

3. The balloon inflating device of claim 1, further comprising:

the second fluidic inlet having a first cross-sectional area;

the first fluidic inlet having a second cross-sectional area; and a ratio of the first and second cross-sectional areas selected to achieve a preferred volumetric ratio of the LTA gas and the second gas when the LTA gas is at a selected first pressure and the second gas is at a second pressure.

4. The balloon inflating device of claim 3, wherein the second cross-sectional area is adjustable to adjust the predetermined mixture of the LTA gas and the second gas to the outlet port.

5. The balloon inflating device of claim 3, further comprising a plurality of selectable first fluidic inlets, the plurality of first fluidic inlets having a corresponding plurality of differing second cross-sectional areas, a first of the first fluidic inlets selected to achieve a ratio of the first and the second cross-sectional areas having a first preferred volumetric ratio of the LTA gas and the second gas when the LTA gas is at a selected first pressure and the second gas is at a second pressure, a second of the first fluidic inlets selected to achieve a ratio of the first and the second cross-sectional areas having a second preferred volumetric ratio of the LTA gas and the second gas when the LTA gas is at the selected first pressure and the second gas is at the second pressure.

6. The balloon inflating device of claim 5, wherein the second gas at the second pressure comprises atmospheric air at ambient pressure.

7. The balloon inflating device of claim 1, wherein the first gas comprises helium.

8. The balloon inflating device of claim 1, wherein the second gas comprises atmospheric air.

9. The balloon inflating device of claim 1, wherein the first fluidic inlet comprises a single aperture through the outer pipe to the inner chamber.

10. The balloon inflating device of claim 1, wherein the first fluidic inlet comprises a pair of apertures through the outer pipe to the inner chamber.

11. The balloon inflating device of claim 1, wherein the first fluidic inlet comprises a flow path and a gap through a threaded coupling between the outer pipe and a cap forming the closed first end of the outer pipe.

12. A device for inflating a balloon, comprising:

a gas mixing device fluidly connecting a supply of pressurized lighter-than-air (LTA) gas and atmospheric air to a balloon interface nozzle via a gas shut-off valve;

the gas mixing device including an outer pipe including a closed first end, an inner chamber, an inner pipe projecting through the closed first end of the outer pipe into the inner chamber, a first fluidic inlet and an outlet port, wherein the inner pipe includes a second fluidic inlet into the inner chamber;

the second fluidic inlet fluidly connecting to the supply of LTA gas and oriented downstream of the first fluidic inlet;

the first fluidic inlet proximal to the closed first end and fluidly connecting to the atmospheric air;

a second end of the outer pipe fluidly connecting to the outlet port; and the outlet port fluidly connecting via the gas shut-off valve to the balloon interface nozzle;

wherein the gas shut-off valve comprises an outer pipe, a seat, and a ball valve, wherein the seat is formed on an annular outlet of the outlet port of the gas mixing device and the outer pipe houses the ball valve.

13. The balloon inflating device of claim 12, further comprising:

the second fluidic inlet having a first cross-sectional area;

the first fluidic inlet having a second cross-sectional area; and a ratio of the first and second cross-sectional areas selected to achieve a preferred volumetric ratio of the LTA gas and atmospheric air when the LTA gas is pressurized at a selected first pressure.

14. The balloon inflating device of claim 13, wherein the second cross-sectional area is adjustable to adjust the predetermined mixture of the LTA gas and the atmospheric air delivered to the outlet port.

15. The balloon inflating device of claim 12, further comprising:

a plurality of the first fluidic inlets having a corresponding plurality of differing second cross-sectional areas;

a first of the first fluidic inlets selected to achieve a ratio of the first and the second cross-sectional areas having a first preferred volumetric ratio of the LTA gas and atmospheric air when the LTA gas is pressurized at a selected first pressure; and a second of the first fluidic inlets selected to achieve a ratio of the first and the second cross-sectional areas having a second preferred volumetric ratio of the LTA gas and atmospheric air when the LTA gas is pressurized at the selected first pressure.

16. The balloon inflating device of claim 12, wherein the first fluidic inlet comprises a single aperture through the outer pipe to the inner chamber.

17. The balloon inflating device of claim 12, wherein the first fluidic inlet comprises a flow path and a gap through a threaded coupling between the outer pipe and a cap forming the closed first end.

18. The balloon inflating device of claim 12, wherein the gas shut-off valve further comprises a shutoff guard disposed between the ball valve and the balloon interface nozzle.

19. A balloon inflating device, comprising:

a gas mixing device fluidly connected to a pressurized lighter-than-air (LTA) gas source via a controllable flow control valve;

the gas mixing device fluidly connected to a balloon inflation nozzle via a shut-off valve, wherein the gas shut-off valve comprises an outer pipe, a seat, a ball valve and a shutoff guard, wherein the seat is formed on an annular outlet of the outlet port of the gas mixing device, the outer pipe houses the ball valve, and the shutoff guard is located between the ball valve and the balloon interface nozzle; and the controllable flow control valve signally connected to an actuator and a balloon parameter selector;

wherein:

in response to an activation signal from the actuator, the controllable flow control valve permits flow of the pressurized LTA gas to the gas mixing device responsive to the balloon parameter selector to generate a mixture of LTA gas and atmospheric air in the gas mixing device that urges past the shut-off valve and flows to the balloon inflation nozzle; and in response to a deactivation signal from the actuator, the controllable flow control valve deactivates and the shut-off valve interrupts flow between the balloon inflation nozzle and the gas mixing device.

20. The balloon inflating device of claim 19, wherein the gas mixing device further comprises:

an outer pipe including a closed first end, an open second end defining an outlet port, a first fluidic inlet and an inner pipe projecting through the closed first end of the outer pipe into the inner chamber, wherein the inner pipe includes a second fluidic inlet;

the first fluidic inlet fluidly connecting an outer portion of the outer pipe and the mixing chamber, said first fluidic inlet fluidly connected to atmospheric air;

the inner pipe fluidly connected to the pressurized LTA gas;

the second fluidic inlet of the inner pipe oriented downstream of the first fluidic inlet; and the outlet port fluidly connected via the shut-off valve to the balloon inflation nozzle.

* * * * *